US007062812B1

(12) United States Patent
Morris

(10) Patent No.: US 7,062,812 B1
(45) Date of Patent: Jun. 20, 2006

(54) ARCH BRIDGE

(76) Inventor: David C. Morris, 455 W. 23rd St., Apt. 14F, New York, NY (US) 10011

( * ) Notice: Subject to any disclaimer, the term of this patent is extended or adjusted under 35 U.S.C. 154(b) by 0 days.

(21) Appl. No.: 11/294,814

(22) Filed: Dec. 5, 2005

Related U.S. Application Data

(60) Provisional application No. 60/635,089, filed on Dec. 10, 2004, provisional application No. 60/633,835, filed on Dec. 6, 2004, provisional application No. 60/633,836, filed on Dec. 6, 2004.

(51) Int. Cl.
*E01D 4/00* (2006.01)
*E01D 11/00* (2006.01)

(52) U.S. Cl. ..... 14/18; 14/24; 14/25

(58) Field of Classification Search ..... 14/2, 14/18, 19, 24, 25
See application file for complete search history.

(56) References Cited

U.S. PATENT DOCUMENTS 2,960,704 A * 11/1960 Stoltenburg ..... 14/18
3,359,587 A * 12/1967 Pleasants ..... 14/19
3,654,652 A * 4/1972 Pleasants ..... 14/18
6,401,285 B1 * 6/2002 Morris ..... 14/19

* cited by examiner

*Primary Examiner*—Gary S. Hartmann
(74) *Attorney, Agent, or Firm*—Law Office of Timothy E. Siegel; Timothy E. Siegel

(57) ABSTRACT

A bridge, comprising a set of arches, each extending longitudinally along the bridge, including at least one central arch and at least two side arches, symmetrically disposed about the central arch. The side arches are slanted transversely inwardly so that they are closest at the longitudinal center of the bridge and are generally disposed either above or below the central arch. In addition, transverse members connect the arches together and a deck is suspended from the set of arches.

3 Claims, 6 Drawing Sheets

ARCH BRIDGE

RELATED APPLICATIONS

This application claims priority from provisional application 60/633,835 and 60/633,836, both filed on Dec. 6, 2005; and provisional application 60/635,089 filed Dec. 10, 2004.

BACKGROUND OF THE INVENTION

A successful bridge design should be gracious, resilient to earthquakes and the elements in general, and inexpensive to construct. Although a great many bridge designs have already been introduced, it is nevertheless true that not all problems associated with bridge design have been solved. Accordingly, additional, novel bridge designs may yield benefits currently not available in the library of designs.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention takes the form of a bridge, comprising a set of arches, each extending longitudinally along the bridge, including at least one central arch and at least two side arches, symmetrically disposed about the central arch. The side arches are slanted transversely inwardly so that they are closest at the longitudinal center of the bridge and are generally disposed either above or below the central arch. In addition, transverse members connect the arches together and a deck is suspended from the set of arches.

In a second separate aspect, the present invention takes the form of a bridge, comprising a pair of arches extending longitudinally across the bridge. These arches cross each other transversely. Also, a deck is suspended from the pair of arches.

In addition to the exemplary aspects and embodiments described above, further aspects and embodiments will become apparent by reference to the drawings and by study of the following detailed descriptions.

Exemplary embodiments are illustrated in referenced figures of the drawings. It is intended that the embodiments and figures disclosed herein are to be considered illustrative rather than restrictive.

DETAILED DESCRIPTION OF THE PREFERRED EMBODIMENT(S)

Figure 1:
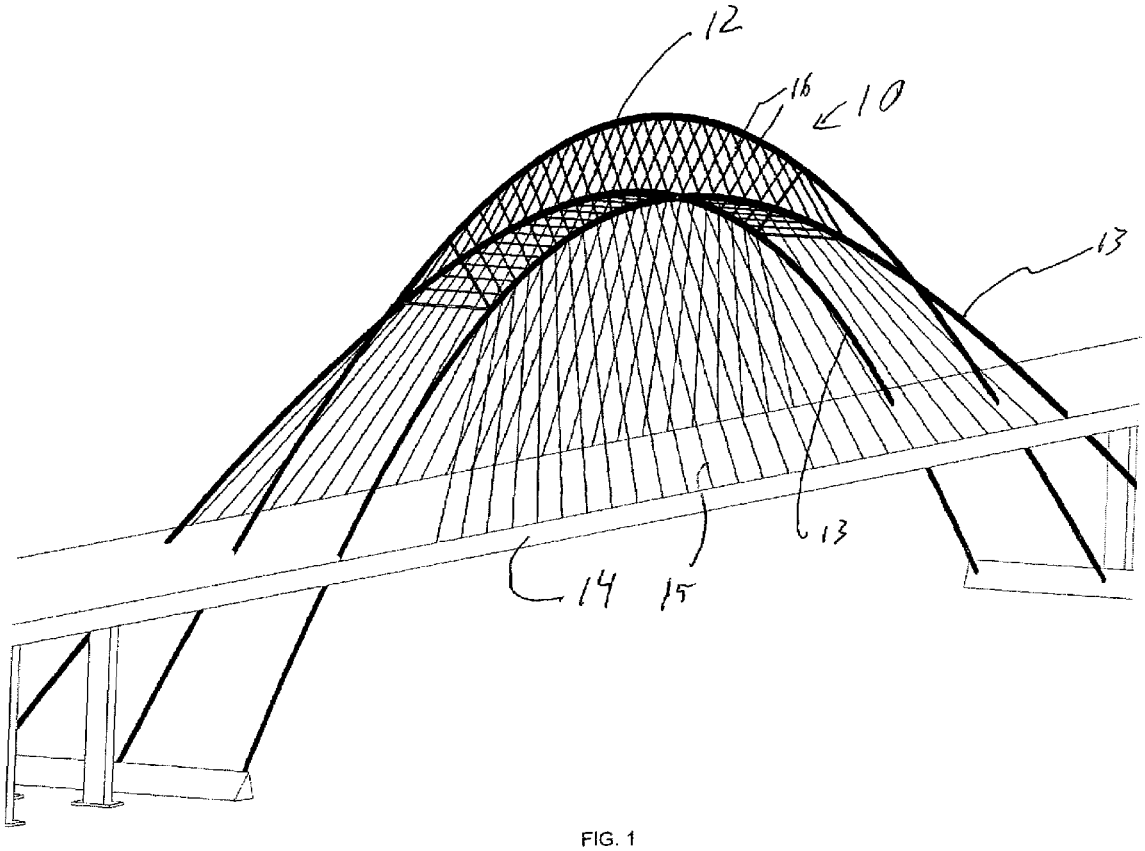
FIG. 1 is an axonometric view of a bridge comprising three arches according to a preferred embodiment, having a high central arch and two lower side arches.
Figure 2:
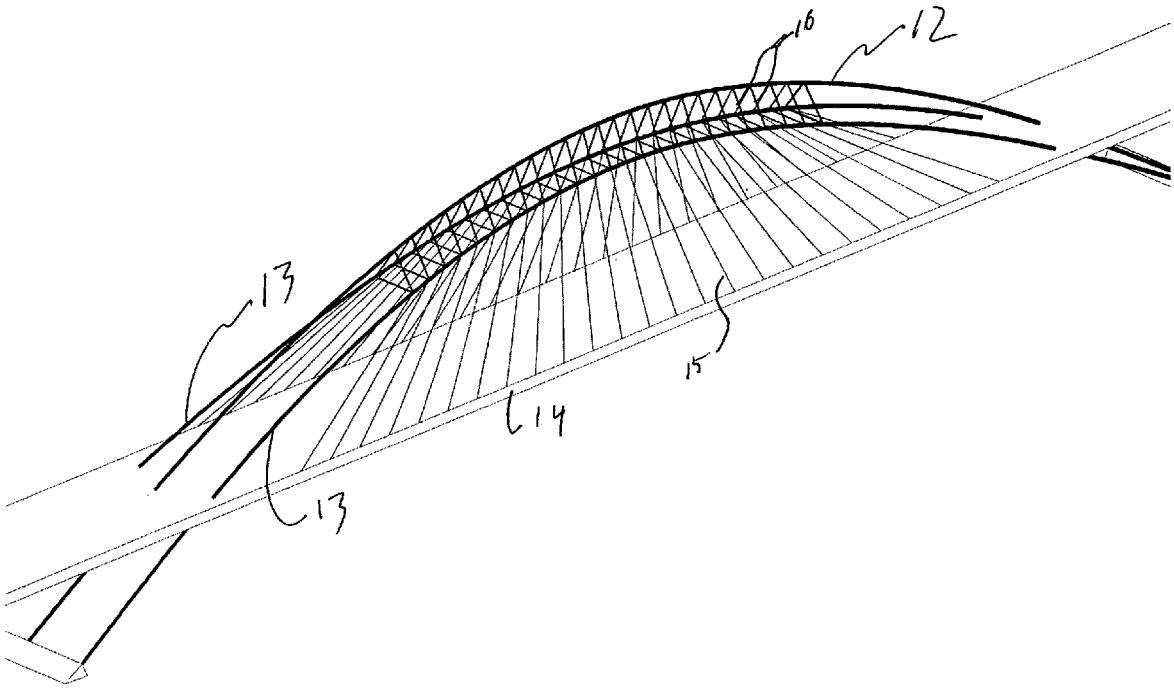
FIG. 2 is an axonometric view of the bridge of FIG. 1 from a higher and more distant vantage point.
Figure 3:
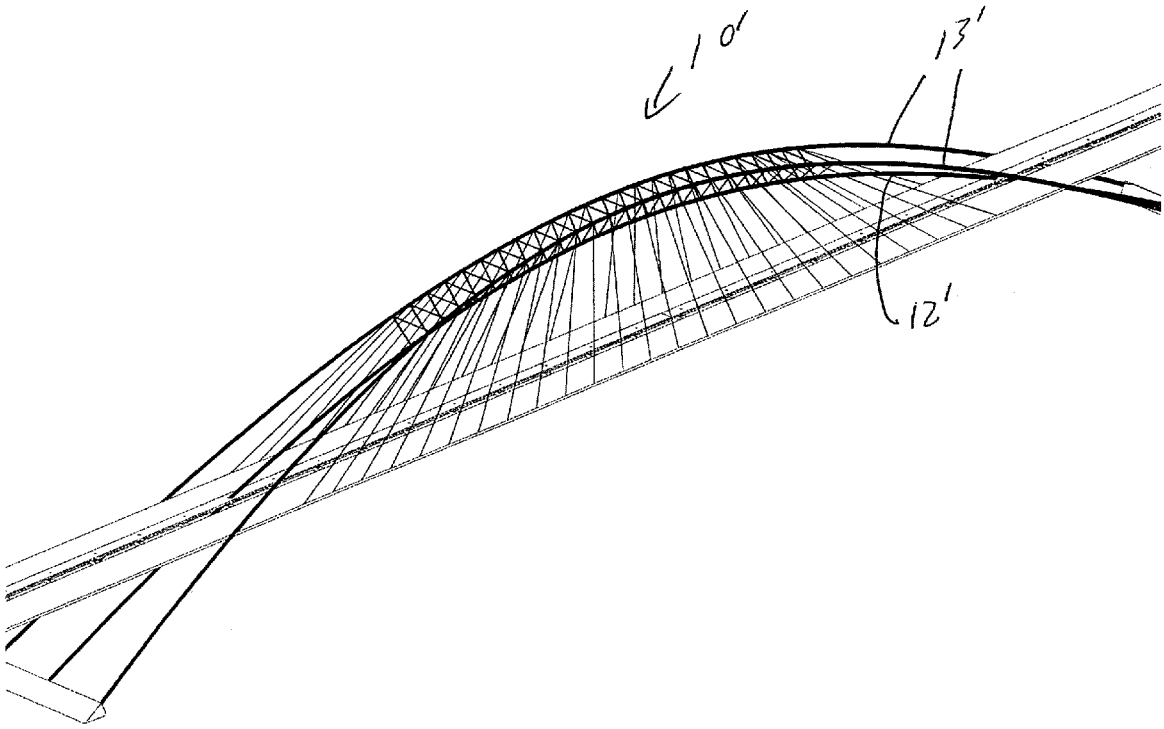
FIG. 3 is an axonometric view of a three-arch bridge according to an alternative preferred embodiment.

One preferred embodiment is in the form of a bridge 10 has a center longitudinal arch 12 and two side arches 13 from which a deck 14 is suspended by a set of cables 15. All three arches 12 and 13 extend from below the suspended deck 14 and arch high over the middle of the bridge's 10 longitudinal expanse. The center, uppermost, arch 12 rises from and descends back through the center of the bridge's width. The two external arches 13 rise from and descend on either side of the width of bridge 10. Above the deck 14 external arches 13 are connected each other and to the center arch 12 and by a longitudinal array of transverse beam sets 16, each in the form of a triangle. One of the sets 16 is placed at the apex of the three arches 12, with the remaining sets 16 spaced equal distances apart, on each side of the apex and descending on either longitudinal side. Referring to FIG. 3, in an alternative preferred embodiment 10' a center arch 12' is lower than the two side arches 13'.

Both embodiments 10 and 10' appear to have good torsional resistance, so that they are not easily moved by the wind or adversely affected by the varying loads caused by daily traffic patterns, in which one side is more heavily weighted during the morning commute and the other side is more heavily weighted during the evening commute. In addition, both appear to have good resistance to earthquake damage.

Figure 4:
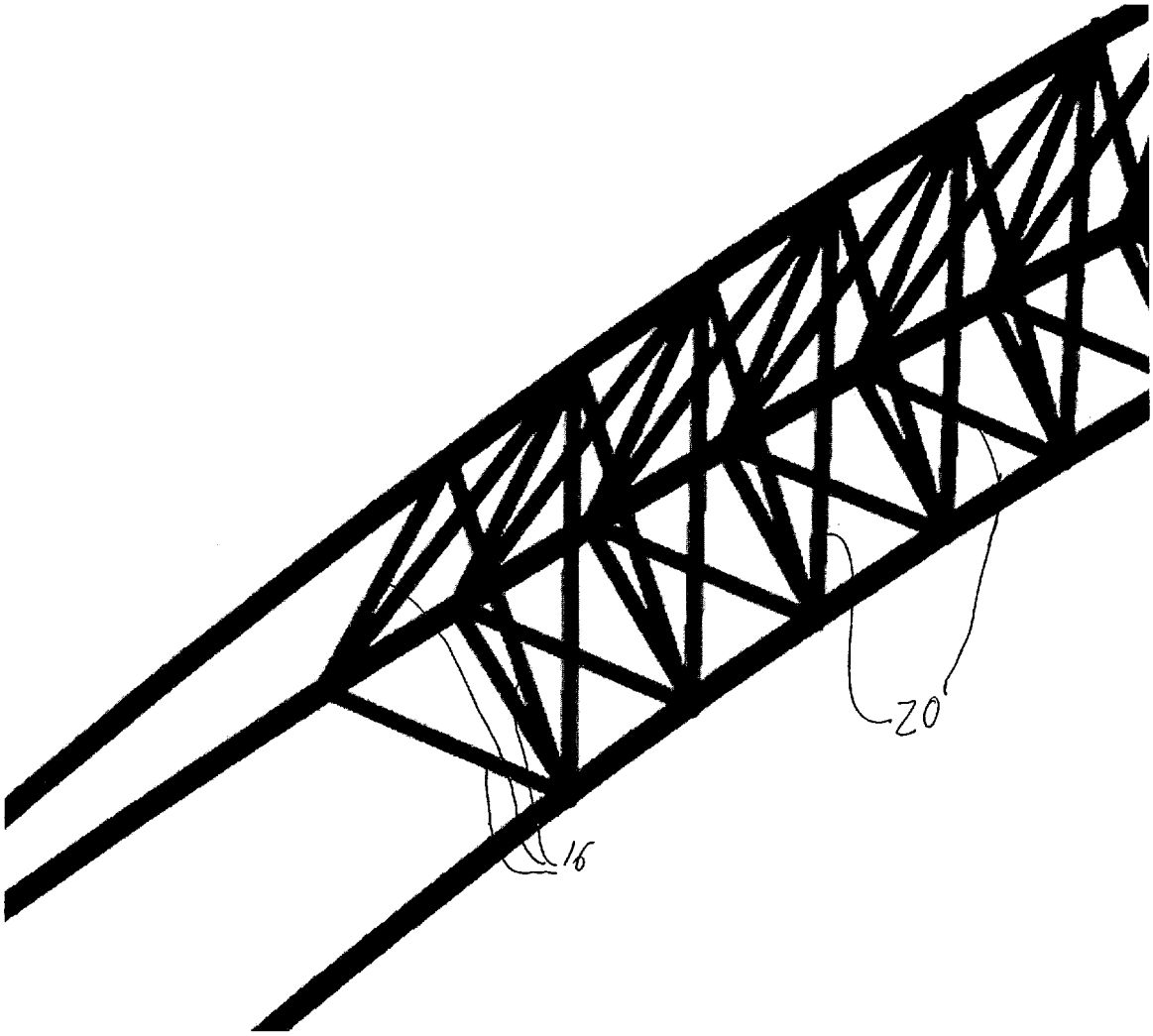
FIG. 4 is an axonometric view of a portion of an alternative embodiment of a three arch bridge, showing additional transverse members.

Referring to FIG. 4, it would also be possible to link the arches 12 and 13 together with members 20 that extend both transversely and longitudinally. In particular, in one preferred embodiment, the transverse members 16 and 20, together with arches 12 and 13, form a fully triangulated support structure. In another preferred embodiment transverse members 16 are not aligned but are staggered longitudinally relative to each other.

Figure 5:
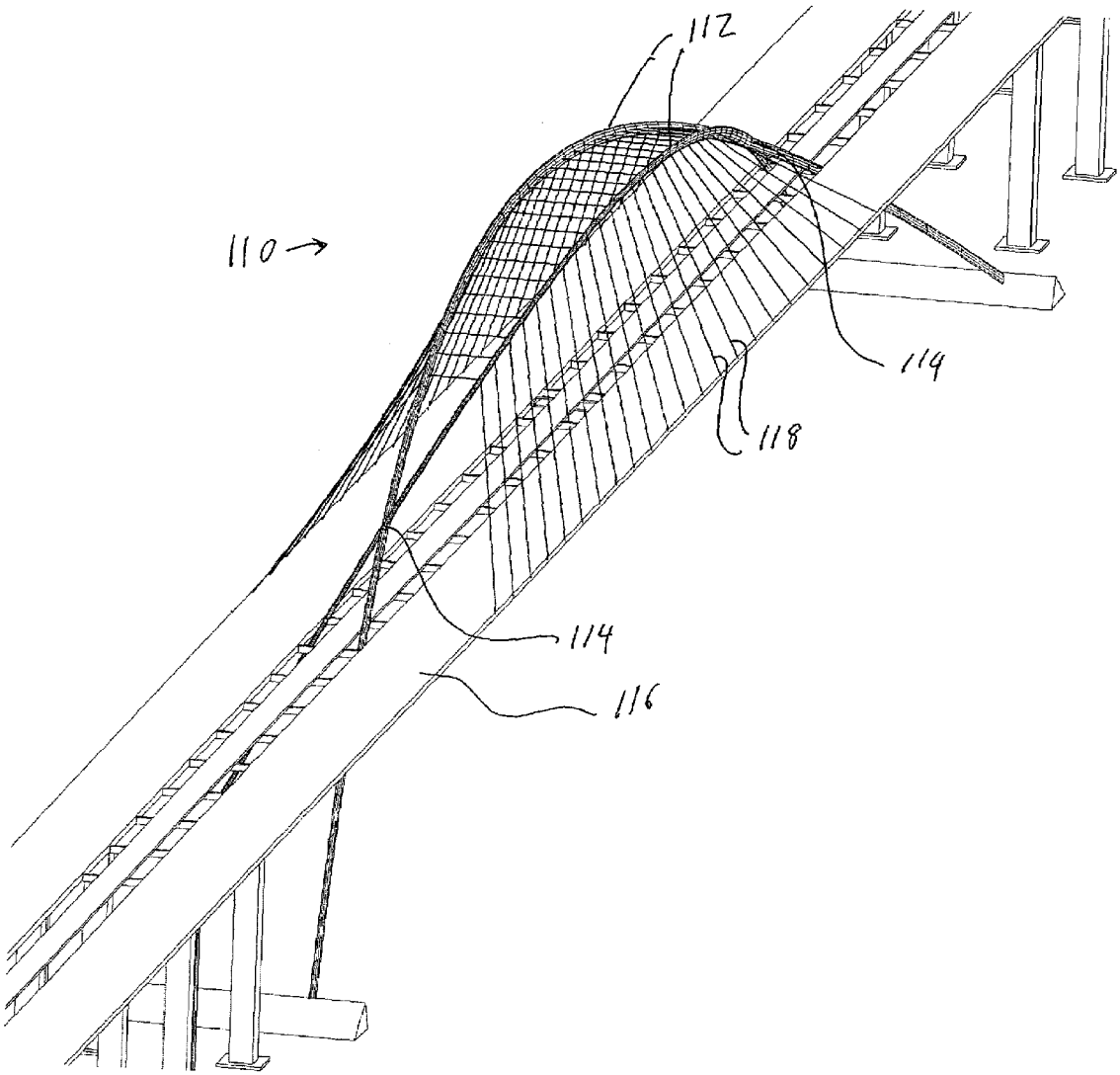
FIG. 5 is an axonometric view of an alternative preferred embodiment of a bridge having two crossing arches.
Figure 6:
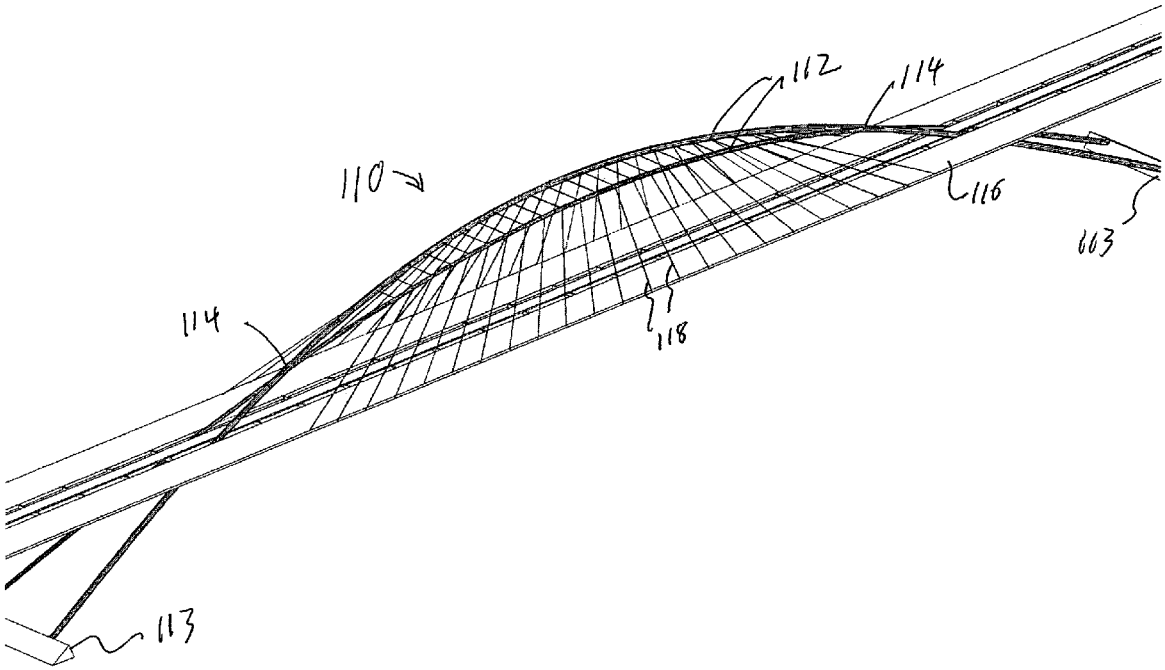
FIG. 6 is an axonometric partial view of the bridge of FIG. 4, from a lower vantage point.

Referring to FIGS. 5 and 6, in an additional alternative preferred embodiment, a bridge 110 includes a pair of arches 112 that extend from a pair of bearing points 113 and cross transversely at a pair of crossover points 114, as they extend longitudinally across said bridge 110. A deck 116 is supported by and suspended from the arches 112. A set of cables 118 are used to suspend the deck from the arches 112. The portion of arches 112 extending from bearing points 113 to crossover points 114 may be thought of as forming triangulated piers.

All of the embodiments discussed have the advantage of enhanced strength due to the use of structurally powerful elements, such as the triangular arrangement of beam sets 16. Accordingly, these bridges are able to survive significant earthquake events and to bear a significant wind load.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A bridge, comprising:

(a) a set of arches, each extending longitudinally along said bridge, including at least one central arch and at least two side arches, symmetrically disposed about said central arch, said side arches slanted transversely inwardly so that they are closest at the longitudinal center of said bridge and being generally disposed either above or below said central arch;

(b) transverse members connecting said arches together; and (c) a deck, suspended from and supported by said set of arches.

2. The bridge of claim 1, in which said center arch is above said side arches at said longitudinal center of said bridge.

3. The bridge of claim 1, in which said center arch is below said side arches at said longitudinal center of said bridge.

* * * * *